United States Patent [19]

Earl

[11] Patent Number: 4,995,543

[45] Date of Patent: Feb. 26, 1991

[54] MAGNETIC STEM AND VERTICALLY FIXED POCKET DEVICE FOR A STATIONARY RIVETING MACHINE

[76] Inventor: Gordon C. Earl, 140 Sydenham St., Ganaoque, Ontario K7G 1C2, Canada

[21] Appl. No.: 328,133

[22] Filed: Mar. 23, 1989

[51] Int. Cl.[5] ..... B21J 15/10

[52] U.S. Cl. ..... 227/113; 227/26; 227/115; 227/119; 227/149

[58] Field of Search ..... 227/113, 119, 120, 139, 227/26, 114, 115, 149

[56] References Cited

U.S. PATENT DOCUMENTS

| | | | |
|---|---|---|---|
| 1,524,414 | 1/1925 | Stimpson | 227/119 |
| 2,878,954 | 3/1959 | Troske | 227/119 X |
| 3,586,230 | 6/1971 | Hill et al. | 227/51 |
| 4,251,017 | 2/1981 | Doyle et al. | 227/113 X |
| 4,579,270 | 4/1986 | Matsuda | 227/119 X |
| 4,596,349 | 6/1986 | Herten | 227/119 X |
| 4,609,134 | 9/1986 | Davern | 227/119 X |

*Primary Examiner*—Frank T. Yost
*Assistant Examiner*—Rinaldi Rada
*Attorney, Agent, or Firm*—Bailey & Hardaway

[57] ABSTRACT

A magnetic riveting stem and a novel vertically fixed pocket mechanism is provided for a stationary riveting machine which permits such machines to be used for riveting applications which were impossible or impractical with prior art riveting stem and pocket mechanisms. The vertically fixed pocket receives ferrous rivets from a rivet feed mechanism and aligns them in a head-up orientation to be picked up by the stem for setting through registered holes in the work. A stationary riveting machine equipped in accordance with the invention is capable of setting a ferrous rivet in practically any location on a work piece where the head of the rivet can pass. This offers an advantage over traditionally equipped stationary riveting machines which require vertically displaceable pockets for guiding a rivet to the pilot pin of a rivet anvil.

5 Claims, 3 Drawing Sheets

MAGNETIC STEM AND VERTICALLY FIXED POCKET DEVICE FOR A STATIONARY RIVETING MACHINE

The present invention relates to stationary riveting machines, and in particular, to improvements in a stationary riveting machine whereby a magnetic riveting stem and a vertically fixed pocket mechanism for setting ferrous rivets is provided.

BACKGROUND OF THE INVENTION/PRIOR ART

Stationary riveting machines are well known and widely manufactured. Traditionally, stationary riveting machines include a work table supported on a frame, a riveting plunger or ram supported above the work table, and a riveting stem for setting rivets which is attached to the riveting plunger. The work table is provided with an anvil for upsetting or deforming a rivet after it passes through the registered holes of a work piece. The anvil includes a spring biased pilot pin which is used to register the holes in the work and to guide a rivet through the registered holes. The traditional riveting machine also includes a mechanism commonly known as a "pocket" for transferring a rivet from a rivet feed mechanism to the anvil pilot pin.

A riveting pocket includes a pair of vertically displacable opposing jaws which receive rivets in succession from a rivet feed mechanism. The opposing jaws of a riveting pocket are provided with a vertical bore along their common faces which is sized to accommodate the head of a rivet in an upper region of the bore and the shank of the rivet in a lower region of the bore. Each side of a riveting pocket is attached to a spring-steel pocket arm which permits the opposing jaws of the pocket to be forced apart laterally. The pocket arms are, in turn, connected to a linkage which controls the vertical movement of the pocket.

During each riveting cycle the pocket moves vertically from a rivet receiving position above the work piece to a rivet release position wherein the hollow lower end of the rivet shank has engaged the tip of the pilot pin. Most stationary riveting machines control the vertical movement of the pocket with a spring or cam biased linkage that is attached to the top of the pocket arms. The linkage is adjusted to stop the descent of the pocket when the transferring a rivet from a rivet feed mechanism to the anvil pilot pin.

A riveting pocket includes a pair of vertically displaceable opposing jaws which receive rivets in succession from a rivet feed mechanism. The opposing jaws of a riveting pocket are provided with a vertical bore along their common faces which is sized to accomodate the head of a rivet in an upper region of the bore and the shank of the rivet in a lower region of the bore. Each side of a riveting pocket is attached to a spring-steel pocket arm which permits the opposing jaws of the pocket to be forced apart laterally. The pocket arms are, in turn, connected to a linkage which controls the vertical movement of the pocket.

During each riveting cycle the pocket moves vertically from a rivet receiving position above the work piece to a rivet release position wherein the hollow lower end of the rivet shank has engaged the tip of the pilot pin. Most stationary riveting machines control the vertical movement of the pocket with a spring or cam biased linkage that is attached to the top of the pocket arms. The linkage is adjusted to stop the descent of the pocket when the rivet shank engages the top of the pilot pin. When the pocket is stopped in its downward descent, the opposing jaws of the pocket are forced apart by the descending force of the stem and the rivet follows the pilot pin down through the registered holes of the work pieces and is upset against the anvil on the back side of the work.

The disadvantage of the known stationary riveting machines is the fact that the riveting pocket prevents the setting of rivets in certain areas of a work piece. For instance, using a traditionally equipped riveting machine, one cannot readily set a rivet adjacent a 90° angle, in the bottom of a narrow cylinder, or in any other location where a rivet is desirably set in a portion of the work adjacent some obstruction or protrusion. This problem often requires the use of more expensive and less desirable "pop" rivets or some alternate fastener where an upset rivet cannot be set. In certain applications, the size of a pocket is sometimes reduced to improve the versatility of the machine. Elongated pilot pins which project far enough above the work to guide a rivet past a projecting surface of the work have also been used for setting rivets in certain applications. Neither of these adaptions have proven practical for all applications. Regardless of how thinly the walls of a pocket are made, the pocket still requires considerable operating space, rendering it unsuitable for certain riveting applications. Although an elongated pilot pin may be useful in certain situations where only a few rivets must be set, it is an unsatisfactory method for setting a large number of rivets. There are several disadvantages to working with an elongated pilot pin. Firstly, the pin requires a very long and resilient spring which tends to fatique and wear quickly. Secondly, the extra long projection of the pilot pin provides less clearance between the bottom of a pocket and the top of the pin, which may interfere with the movement of work pieces over the pilot pin. In addition, attempts to match a hole with a very long pilot pin may result in damaging the pilot pin by bending or breaking it and thus rendering it unsuitable for further use.

It is an object of the present invention to provide a riveting stem and a pocket for a stationary riveting machine which is reliably capable of setting ferrous rivets in practically any area of a work piece, including areas adjacent projecting surfaces, inside corners, and within narrow recesses.

It is a further object of the invention to provide a riveting stem and pocket for a stationary riveting machine which are simple to manufacture, operate and maintain.

SUMMARY OF THE INVENTION

The present invention provides a novel magnetic stem for stationary riveting machines. A magnetic stem permits the use of a vertically fixed pocket, eliminating the need for the traditional linkage which controls the vertical movement of a riveting pocket.

In accordance with the preferred embodiment of the invention, a stationary riveting machine is provided with a magnetic stem and a novel riveting pocket which receives ferrous rivets from a rivet feed mechanism and releases them to the stem as the stem descends in its rivet setting stroke. Because the pocket of the present invention does not descend with the stem to guide the rivet onto the pilot pin of the anvil, rivets may be driven in close proximity to vertical surfaces on a work piece.

A stationary riveting machine in accordance with the invention is capable of setting a ferrous rivet in almost any location that permits the passage of the head of a rivet. This adds a great deal of versatility to the capability of the machine and eliminates the traditional problems associated with setting rivets in inaccessible areas of a work piece.

For the purposes of this document, "ferrous rivets", hereinafter generally referred to simply as "rivets" means any rivet which contains sufficient iron to render it magnetic.

The present invention may be described in more general terms as follows.

In a stationary riveting machine, apparatus for setting ferrous rivets having a head portion, a shank portion of smaller cross-section extending therefrom and an axis extending longitudinally of said shank, said apparatus comprising:

a riveting stem connectable with the plunger of said riveting machine, said stem having a shank and a riveting tip, at least a portion of the tip region of said stem being magnetic so as to support one said rivet in a head-up contact therewith; and means for aligning a rivet in the path of said stem and releasing said rivet to said stem before said rivet contacts the pilot pin of the anvil of said riveting machine.

DESCRIPTION OF THE DRAWINGS

A preferred embodiments of the present invention will now be explained by way of example only and with reference to the following drawings wherein:

FIG. 2*a* is an elevational view of the pocket of FIG. 2*a* disassembled into its opposing jaws;

DETAILED DESCRIPTION OF THE INVENTION

Figure 1:
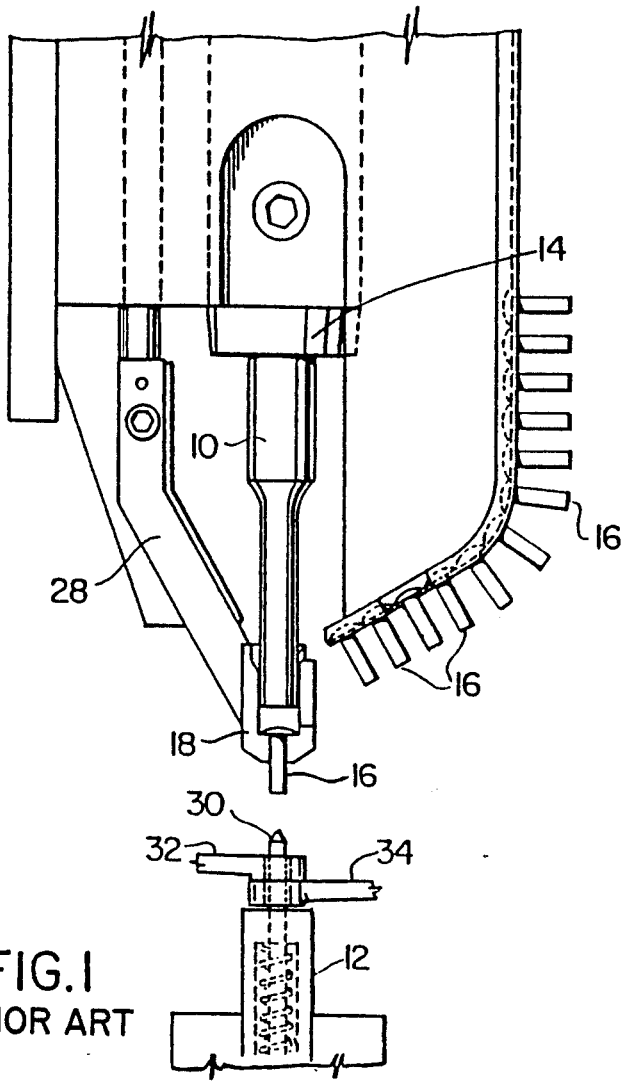
FIG.1 PRIOR ART
FIG. 1 is a partially cut away side elevational view of the rivet setting apparatus of a typical traditional riveting machine.
Figure 2A:
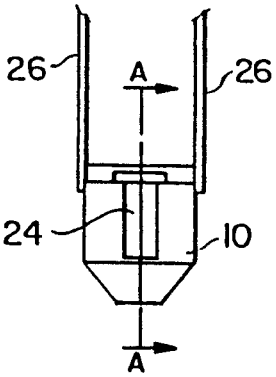
FIG. 2A PRIOR ART
FIG. 2*a* is a detailed front elevational view of a traditional riveting pocket.
Figure 2B:
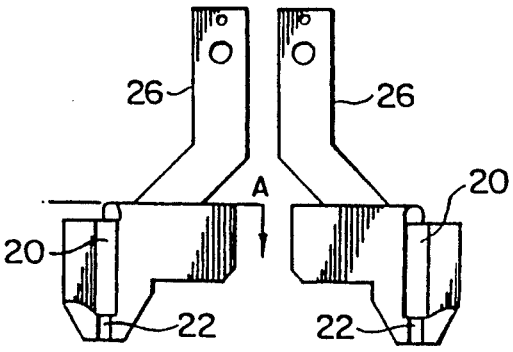
FIG. 2B PRIOR ART

As illustrated in FIG. 1, a traditional stationary riveting machine generally includes a riveting stem 10 which drives a rivet through the registered holes of a work piece. The rivet is upset on the back of the workpiece when it strikes an anvil 12, axially aligned below the end of the stem 10. The stem is driven down by a riveting plunger 14 which is in turn connected to a power source for providing the force required for setting rivets. Rivets 16 are delivered one at a time to a riveting pocket 18. In FIG. 1, only one side of a riveting pocket is illustrated, the opposite side being removed for clarity. A riveting pocket 18 generally includes a hollow cylinder which is split into two jaws along a longitudinal midline. The cylinder has a first bore 20 which accommodates the head of a rivet and a second bore 22 which accommodates the stem of the rivet (FIG. 2*b*). The front face of the cylinder is provided with a vertical slot 24 (FIG. 2*a*) which permits the head and shank of a rivet to slide laterally into the pocket. Rivets are delivered to the pocket by a rivet track 26. This track is fed from a source of rivets and supplies one rivet to the riveting pocket during each riveting cycle. Rivet feed tracks are well known in the art. The pocket 18 is traditionally supported by a pair spring-steel pocket arms 28. The pocket arms are in turn connected to a spring biased or cam actuated linkage which controls the vertical movement of the pocket relative to the riveting stem and plunger.

In FIG. 1, the stem 10 has just entered the pocket 18 during its descent for setting the rivet 16. The pocket 18 must descend with the stroke of stem 10 until the hollow tip of rivet 16 engages the pointed tip of the pilot pin 30 which projects up through the registered holes in work pieces 32 and 34. The pilot pin 30 is spring biased and projects through a concentric bore in the end of anvil 12. Pilot pin 30 serves the dual purpose of assisting in registering the holes in work piece 32 and 34 as well as guiding the end of the shank of rivet 16 through the registered holes in the work pieces. The spring biased arms (not illustrated) which control the vertical movement of pocket 18 are adjusted to stop the pocket 18 when the end of rivet 16 is in firm contact with the top of pilot pin 30. When the pocket 18 is stopped in its downward travel, the pressure of stem 10 forces the opposing jaws of pocket 18 to separate laterally, permitting the stem to descend with the rivet, forcing the spring loaded pilot pin 30 into its socket and upsetting the shank of rivet 16 against anvil 12 on the back side of the work piece 34.

As is readily apparent from the above, the pocket 18 must descend within close proximity of the work piece before releasing a rivet. Since the pockets are relatively bulky in size, traditionally equipped stationary riveting machines are not capable of setting rivets in areas closely adjacent to vertical surfaces on a work piece.

Figure 3:
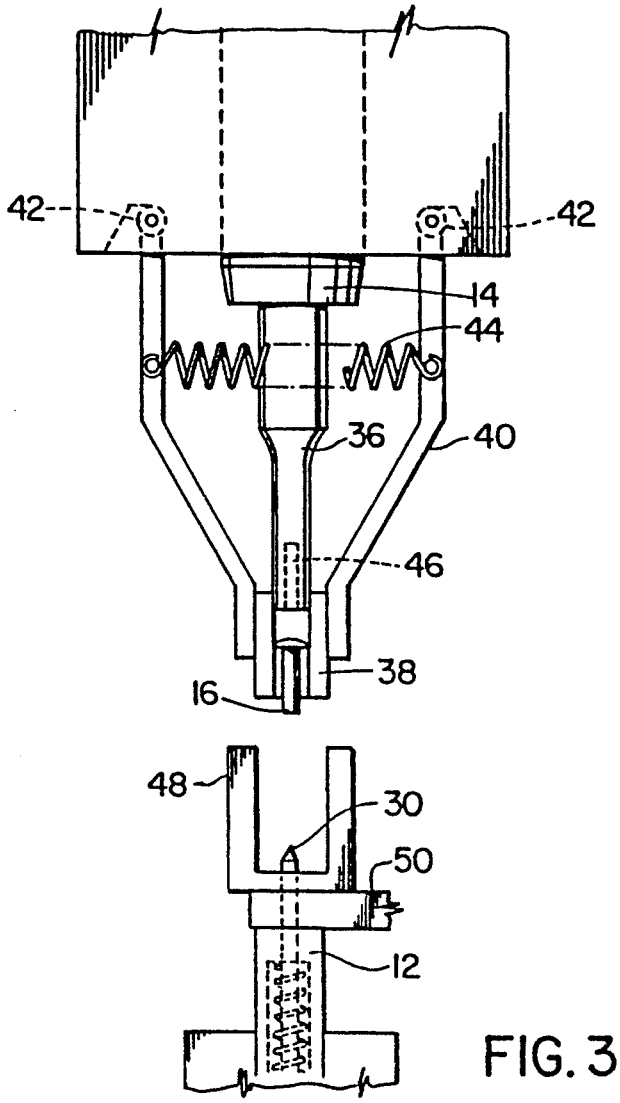
FIG. 3 is a partially cut away front elvational view of the rivet setting components of a stationary riveting machine equipped in accordance with the invention.

FIG. 3 illustrates a novel rivet setting apparatus in accordance with the invention. The apparatus includes a magnetic stem 36, a novel pocket 38, shown partially cut away for clarity, and pocket support arms 40. It should be noted that pocket support arms 40 are pivotally connected to the head of the riveting machine by bolts 42. The pocket may alternatively be attached to another convenient location on the machine. Pocket support arms 40 are biased toward each other by a coil spring 44 attached across the opposing arms. Alternatively, the pocket support arms 40 may be biased toward each other by leaf springs which exert inward pressure on the outer surface of each arm. Stem 36 is preferably constructed of stainless steel and includes a magnetic insert 46 so that, as the stem descends in its rivet setting stroke, the rivet 16 adheres to the end of the stem 36 and is centered on the stem as it passes through the pocket bore which is approximately the same diameter as the rivet head and the end of the stem. Because the pocket 38 is vertically fixed, stem 36 forces the opposing jaws of pocket 38 apart laterally and descends with rivet 16 to pilot pin 30. As the the pocket 38 does not have to control rivet 16 to the point that it contacts pilot pin 30, a rivet can be set in locations which were impossible or impractical to reach with traditional rivet setting apparatus. As shown in FIG. 3, a rivet may be set in the bottom of a channel 48 which is being riveted to a flat bar 50. The same operation with the apparatus shown in FIG. 1 would be impossible without the use of an elongated pilot pin.

Figure 4A:
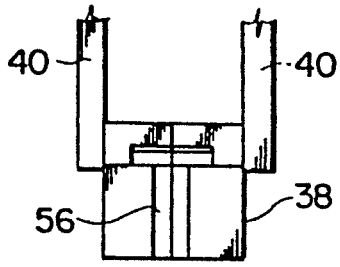
FIG. 4*a* is a front elevational view of a riveting pocket in accordance with the invention.
Figure 4B:
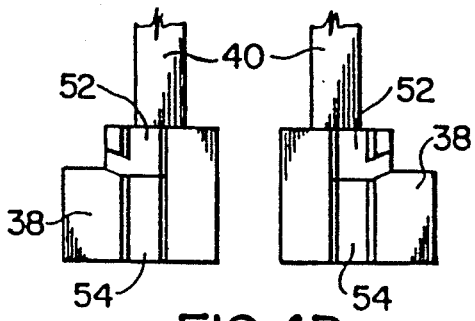
FIG. 4*b* is a front elevational view of the riveting pocket of FIG. 4*a* disassembled into its opposing jaws.

FIG. 4*b* is a detailed illustration of the pocket 38 shown in FIG. 3. The pocket illustrated is constructed from a substantially square block, however, the exterior shape of the pocket is of no consequence. The pocket is preferably constructed from non-magnetic material such as stainless steel, nylon, bronze, a cast aluminum alloy or some other durable non-magnetic material. It is preferred that pockets in accordance with the invention be constructed from non-magnetic material so that no magnetism is passed from the stem via the pocket to the rivet feed mechanism. Magnetism passed to a rivet feed mechanism inevitably impairs its proper functioning by causing rivets to stick to the end of the feed track and is therefore undesirable. If a pocket constructed from non-magnetic material is used, this problem is avoided. Stainless steel is the preferred material because it is more durable and easily worked than most other materials, though other non-magnetic materials are equally satisfactory in terms of function. A pocket 38 in accordance with a preferred embodiment of the invention may be constructed as follows.

(a) a pair of appropriately sized stock pieces having common plane faces are clamped together;

(b) a vertical bore 54 equal to the head diameter of the rivet is drilled along the junction line of the two stock pieces;

(c) 0.010 inches is removed from the drilled face of each block;

(d) the blocks are reclamped together and the top of the block is redrilled to form the bore 52 having the diameter of the rivet head plus 0.015 inches;

(e) a vertical notch is ground to communicate from the outside of the pocket to the vertical bore 54, forming slot 56 which provides a passageway for the stem and head of rivets fed to the pocket;

Pockets 38 are assembled to pocket arms 40 and the pocket is ready for assembly to a riveting machine.

A pocket constructed to the above specifications serves for all rivets of a given head diameter, regardless of the rivet shank diameter or the shank length. Conversely, one prior art pocket must be kept in stock for each rivet head and shank diameter combination to be used in riveting applications. Additionally, each prior art pocket can accommodate only a narrow range of rivet shank lengths, further adding to the number of prior art pockets which must be kept in stock.

It will be appreciated by those skilled in the art that many alternative pocket constructions are readily adaptable for use with a riveting stem in accordance with the invention.

Figure 5:
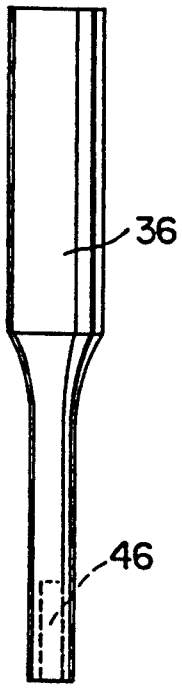
FIG. 5 is a front elevational view of a riveting stem in accordance with the invention.
Figure 6A:
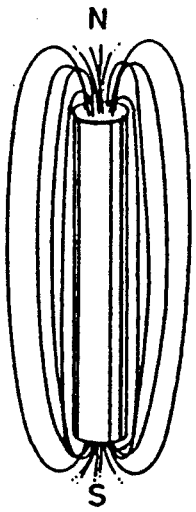
FIG. 6*a* is a schematic view of the magnetic field of a magnetic rod.
Figure 6B:
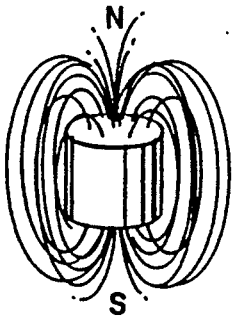
FIG. 6*b* is a schematic view of the magnetic field of a short magnetic cylinder.

FIG. 5 illustrates a riveting stem 36 in accordance with a preferred embodiment of the invention. The stem may be identical in shape to a traditional riveting stem. The preferable construction for a magnetic stem is one turned from a non-magnetic material such as stainless steel. An appropriately sized axial bore is drilled in the tip of the stem. The depth of the bore is not critical but 1.5 cm to 2.5 cm has proven satisfactory. A magnetic rod cut to the proper length is driven into the axial bore in the stem so that it is flush with the end of the stem. A magnetic alloy, known as Alnico, commonly available from steel suppliers, has proven acceptable for this application. A short magnetic cylinder can also be soldered to the end of a stem using a silver solder or an equivalent. This has disadvantages however in that the heat required to solder the magnet to a stem can cause the magnet, stem, or both to become tempered to a brittle consistency which shortens the life of the stem in its riveting application. Additionally, as shown in FIGS. 6*a* and 6*b*, the magnetic field of a short cylinder is more concentrated towards the edge of the cylinder as opposed to the magnetic field of a long thin rod which is more concentrated near the centre of the end of the rod. A rivet head attracted to a short cylindrical magnet is, therefore, more inclined to tip and adhere to one side of the magnet than a rivet attracted by a thin rod axially mounted in a non-magnetic stem. Although the problem of rivet tipping can be controlled with the use of a properly designed pocket, it is preferably avoided with a stem constructed in accordance with the stem illustrated in FIG. 5.

Changes and modifications in the specifically described embodiments can be carried out without departing from the scope of the invention which is intended to be limited only by the scope of the appended claims.

I claim:

1. In a stationary riveting machine, apparatus for setting ferrous rivets having a head portion, a shank portion of smaller cross-section extending therefrom and an axis extending longitudinally of said shank, said apparatus comprising:

a descending riveting stem connectable to a plunger of said riveting machine, said stem having a shank and a riveting tip, at least a portion of the tip region of said being magnetic so as to support one said rivet in a head-up contact therewith; and stationary means defining a vertically fixed pocket bore, said bore positioned in relation to said descending stem, for receiving rivets, in succession, from a rivet source, aligning each rivet in the path of said stem and releasing each rivet to said stem before said rivet contacts a pilot of an anvil of said riveting machine.

2. In a stationary riveting machine, means for receiving rivets from a rivet source and aligning said rivets in the path of said stem as recited in claim 1, said means comprising:

a pocket having opposing jaws for supporting a rivet in a head-up vertical alignment with said stem, said pocket being provided with a vertical slot for laterally receiving rivets from said rivet source;

each said jaw being attached to an arm for supporting it in a vertically fixed position beneath said stem;

said jaws being laterally displaceable and biased toward each other.

3. In a stationary riveting machine, apparatus for setting ferrous rivets having a head portion, a shank portion of smaller cross-section extending therefrom and an axis extending longitudinally of said shank, said apparatus comprising:

a descending riveting stem connectable to a plunger of said riveting machine, said stem having a shank and a riveting tip, at least a portion of the tip of said stem being magnetic so as to support one said rivet in a head-up contact therewith; and stationary means defining a vertically fixed pocket bore, said bore positioned in relation to said descending stem for aligning a rivet in a path of said stem and releasing said rivet to said stem before said rivet contacts a pilot pin of an anvil of said riveting machine.

4. In a stationary riveting machine, means for aligning rivets as recited in claim 1, said means comprising:

a pocket having opposing jaws for supporting a rivet in a head-up vertical alignment with said stem;

each said jaw being attached to an arm for supporting each said jaw in a vertically fixed position beneath said stem;

said jaws being laterally displaceable and biased toward each other.

5. In a stationary riveting machine, a pocket as recited in claim 4 wherein said arms for supporting the opposing jaws of said pocket are pivotally attached to the head of said riveting machine.

* * * * *